United States Patent [19]

Overholser

[11] Patent Number: 4,936,214

[45] Date of Patent: Jun. 26, 1990

[54] APPARATUS FOR ADAPTING OFFSET DUPLICATOR MACHINES TO ACCOMODATE NUMBERING, PRINTING, SCORING, PERFORATING AND LIKE DEVICE

[75] Inventor: Thomas J. Overholser, Chesapeake, Va.

[73] Assignee: Innovative Graphic Industries, Norfolk, Va.

[21] Appl. No.: 373,692

[22] Filed: Jun. 28, 1989

Related U.S. Application Data

[63] Continuation of Ser. No. 1,888, Jan. 9, 1987, abandoned.

[51] Int. Cl.[5] ..... B41F 7/02; B41F 13/00

[52] U.S. Cl. ..... 101/483; 101/DIG. 49; 101/142; 101/76; 101/226; 101/391

[58] Field of Search ..... 101/217, 74, 75, 76, 101/90, 483, DIG. 49, 142, 226, 391

[56] References Cited

U.S. PATENT DOCUMENTS

| | | | |
|---|---|---|---|
| 224,537 | 2/1880 | Hoster | 101/74 |
| 425,298 | 4/1890 | Carlaw | 101/77 |
| 895,079 | 8/1908 | Eigner | 101/74 |
| 1,668,258 | 5/1928 | Adsit | 101/217 X |
| 1,931,566 | 10/1933 | White . | |
| 2,020,479 | 11/1935 | Sites | 101/460 |
| 2,270,272 | 1/1942 | Davidson | 101/217 X |
| 2,270,273 | 1/1942 | Davidson | 101/217 X |
| 2,539,382 | 1/1951 | Davidson | 101/76 |
| 2,629,324 | 2/1953 | Smith | 101/415.1 |
| 2,660,111 | 11/1953 | Herrick et al. | 101/217 X |
| 2,842,202 | 7/1958 | Boyd . | |
| 2,909,117 | 10/1959 | Crissy | 101/137 |
| 2,925,032 | 2/1960 | Glogaud | 101/142 |
| 3,046,877 | 7/1962 | Janke . | |
| 3,554,070 | 1/1971 | Boyd . | |
| 3,611,921 | 10/1971 | Jahn . | |
| 3,616,749 | 11/1971 | Ritzerfeld | 101/76 |
| 3,728,960 | 4/1973 | Heath . | |
| 3,782,277 | 1/1974 | Neal | 101/76 |
| 4,434,715 | 3/1984 | McHenry | 101/76 |
| 4,481,878 | 11/1984 | Hoshi . | |

FOREIGN PATENT DOCUMENTS

| | | | |
|---|---|---|---|
| 957265 | 5/1964 | United Kingdom | 101/217 |

*Primary Examiner*—Clifford D. Crowder

*Attorney, Agent, or Firm*—Sandler, Greenblum & Bernstein

[57] ABSTRACT

An attachment and method for converting a duplicator to a multi-purpose machine capable of printing serial numbers, designs, logos and signatures, as well as scoring and perforating work sheets including a chase adapted to be attached to a blanket cylinder of a duplicator machine for receiving implements for serial numbering, printing signatures, designs and logos, perforating and scoring.

4 Claims, 19 Drawing Sheets

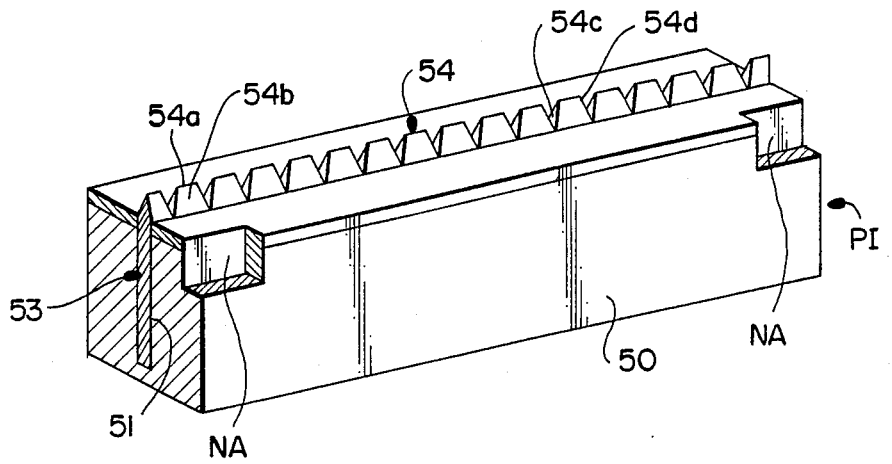
Fig. 5
Fig. 6
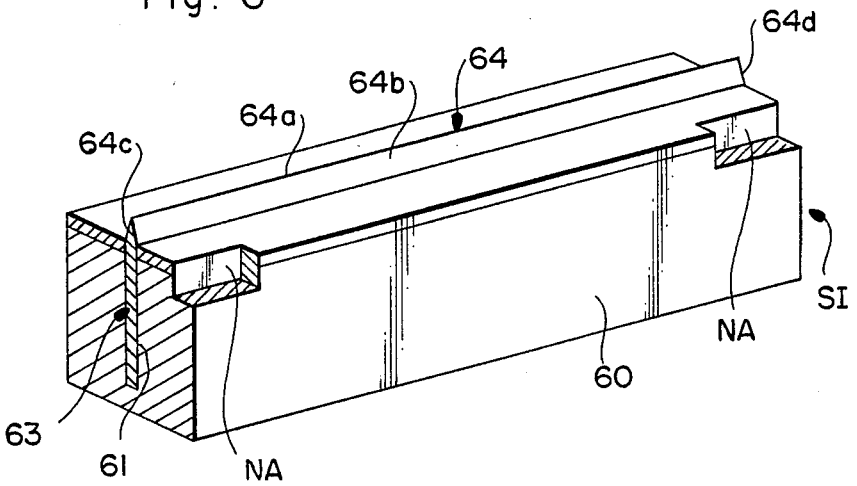

APPARATUS FOR ADAPTING OFFSET DUPLICATOR MACHINES TO ACCOMODATE NUMBERING, PRINTING, SCORING, PERFORATING AND LIKE DEVICE

This is a continuation of Ser. No. 07/001,888 filed Jan. 9, 1987, now abandoned, the disclosure of which in its entirety is hereby incorporated by reference thereto.

BACKGROUND OF THE INVENTION

1. Field of the Invention

The present invention relates to offset duplicator machines. In particular, the present invention is directed to apparatus for attachment to cylinders of an offset duplicator machine to adapt the machine for uses other than offset duplication, such as serial numbering, general printing, scoring and perforation of the stock. Specifically, the present invention is directed to apparatus to be attached to the blanket cylinder of an offset duplicator machine which is designed to accommodate a serial numbering device, a signature logo or design block, a scoring implement, or a perforation implement, so as to convert a standard offset duplicator machine into a multi-purpose apparatus.

2. Discussion of Background and Material Information

A standard piece of equipment in most modern print shops is an offset duplicator machine. This type of machine has been found to be particularly suitable for duplication or printing of most types of business and office stationery including business forms, such as invoices, as well as advertising and promotional materials. Although many jobs for which offset duplicator machines are used do not require additional functions, many require that the stock be either perforated or, scored or be provided with serial numbers or other printed matter, such as signature, designs, logos and the like.

Commercial products are sold for the purpose of adapting a standard duplicator machine to have additional capabilities of scoring and perforation. U.S. Pat. Nos. 2,842,202 and 3,554,070 relate to such attachments. A common brand of such attachments are "Litho-Slit" and "Litho-Perf" which are metal strips to be applied to the impression cylinder of a duplicator which, when compressed against stock passing between the blanket cylinder and the impression cylinder, causes the stock to become scored or perforated, respectively, as the case may be. A common problem associated with such attachments, however, is that they impart localized pressure against the blanket at the score and perforation site which ultimately damages the blanket. Another disadvantage is that such adhesive strips are not amenable to adjustment once they have been placed on the cylinder.

Although efforts have been made to modify conventional printing presses to accommodate a serial numbering printing unit, such attempts have not met with much commercial acceptance or success. Typically, in serial number printing units, the serial number is printed by the numbering device on the surface of a sheet of stock which will face a blanket on the periphery of the impression cylinder when the sheet passes between the cylinders. Thus, the printed serial number tends to be transferred from the sheet onto the blanket under pressure imposed when a pattern is imprinted on the sheet. The transferred serial number is then transferred from the blanket back onto a next sheet where it bears a newly printed serial number. Attempts have been made to eliminate this problem by cutting a hole in the blanket at a position aligned with printed serial numbers to avoid the build-up of ink on the blanket which can blur the transfer of the image. Such a modified blanket, however, is destroyed for purposes of printing. Moreover, this unit does not have the capabilities of scoring and perforating nor is designed to accept signature and/or design blocks. Thus, it is not a multi purpose unit.

In addition, apparatus for printing serial numbers on sheets of stock material, such as that which is disclosed in U.S. Pat. No. 4,481,878, have been developed in an attempt to improve earlier number devices Such serial numbering machines typically imprint the serial number simultaneously with the other impressions. Although such an apparatus is advantageous in that it permits one-step printing and numbering, as a practical matter, it poses problems which have been difficult to overcome. In this regard, the most common problem associated with a one-step printing and numbering apparatus is that the sheets of stock material are numbered in series without any regard for the quality of the printed material on the stock. Normally in the course of printing operations, a certain number of the sheets of printed material are unacceptable for one reason or the other. A common defect would be smudged lines or nonuniformity of the printed image. For a typical run, this poses no particular problems in that it is a simple matter to dispose of the defective sheets. In a run, however, where the sheets are provided with serial numbers, the solution is not so simple. If the reject sheets are observed soon enough, the machine can be stopped and the serial numbering device reset to begin the numbering of the sheets as of the number of the reject sheet. If, however, reject sheets are not discovered until the run is completed, special measures must be taken to provide replacement printed sheets with the appropriate numbers. This is a particularly time-consuming and, consequently, expensive procedure.

Representative examples of offset printing machines equipped with a numbering device include U.S. Pat. No. 3,611,921, wherein a plurality of numbering mechanisms are mounted on a sprocket wheel shaft of an endless chain delivery which cooperates with a counter pressure roller which is located downstream of the impression cylinder of the offset printing machine in the travel direction of the sheet being fed therethrough. This is in contrast to prior conventional printing machines wherein the numbering devices may be located directly at the impression cylinder of the offset printing machine. The numbering mechanisms are located on a circular segment around a sprocket wheel shaft in the region of the periphery which carries the imprinted surface of the sheet when the sheet is being moved from the counter pressure cylinder.

U.S. Pat. No. 3,728,960 is directed to a number-printing apparatus which is mounted to an otherwise conventional offset lithographic printing apparatus, including a conventional main cylinder having a plate segment and an impression segment which revolve with the main cylinder in contact with the smaller, lower cylinder that is normally covered with a thick rubber surface mat or blanket. The number-printing apparatus is capable of end-wise withdrawal from the printing zone for convenient, rapid resetting of the numbering mechanism, when this becomes necessary.

U.S. Pat. No. 1,931,566 is directed to a rotary machine used for numbering sheets of paper stock which includes a plurality of rotatably mounted numbering head-wheels which have a coacting impression roller which are rotatably innerconnected.

Notwithstanding the prior art attempts to provide a convenient serial-numbering device for use with offset duplicators and other printing apparatus, it is not believed that prior art attempts to resolve the previously discussed problems have done so in a manner which is as simple and yet as effective as accomplished by the apparatus of the present invention, as described in more detail hereinbelow. More particularly, prior to the present invention, it is not believed that cylinders of conventional offset duplicator machines had been adapted to receive a serial numbering device, a signature logo or design block, a scoring implement or a perforation implement so as to convert a standard offset duplicator into a multi purpose apparatus.

SUMMARY OF THE INVENTION

It is an object of the present invention to provide a chase for receiving implements to be impressed against work sheets adapted to be connected to a cylinder of a duplicator machine. In one embodiment, the chase has an essentially L-shaped cross-section and includes a base side provided with holes located so as to align with holes in the cylinder frame to adapt the chase for attachment to the cylinder frame, and a lateral side extending upwardly from the base side and having extreme opposite corners each of which is provided with at least one orifice adapted to receive an adjustment screw, in addition to a plurality of tapped holes along a longitudinal axis of the lateral side adapted to receive threaded bolts for securing an implement to the chase. In another embodiment, the chase is essentially an elongate, generally U-shaped element defining a channel for receiving the implement having a base surface side provided with a plurality of holes at least two of which holes are located so as to be aligned with holes in the cylinder frame so as to adapt the chase to be attached to the cylinder frame by means of screws; lateral surface side provided with at least one orifice adapted to receive a set screw for securing the implement within the channel; another lateral surface side provided with at least one orifice in the area of its upper extreme opposite corners adapted to receive an adjustment screw, wherein the orifice adapted to receive a set screw may be elongate slot or includes a plurality of orifices arranged along an axis parallel with an upper edge of the first lateral surface side. A corner of the chase formed by the lateral surface side adapted to receive the set screw and the base surface side is preferably provided with a bevelled edge along at least one section of the length of the corner, and preferably two sections located so as to seat against protuberances in the cylinder frame.

It is another object of the present invention to provide an attachment for a duplicator machine including a chase for receiving implements to be impressed against work sheets adapted to be connected to a cylinder of a duplicator machine composed of an elongate generally U-shaped element defining a channel for receiving the implement having a base surface side provided with a plurality of holes at least two of which are located so as to be aligned with holes in the cylinder frame so as to adapt the chase to be attached to the cylinder frame by means of screws; a first lateral surface side provided with at least one orifice adapted to receive a set screw for securing the implement within the channel; a second lateral surface side provided with at least one orifice in the area of its upper extreme opposite corners adapted to receive an adjustment screw; and an implement for pressing against a work sheet, wherein the implement is selected from the group of devices including a numbering device, a signature block, a design block, a logo block, a perforation device, and a scoring device.

It is a further object of the present invention to provide a perforation device adapted to be inserted into a chase attached to a cylinder of duplicator machine including a generally elongate base provided, with a longitudinal slot for receiving means for perforation; and means for perforation composed of a strip of metal having one elongate side edge disposed in the slot, and an opposite elongate side edge provided with projections extending above the elongate base in a direction perpendicular to a longitudinal axis of the strip.

It is yet a still further object of the present invention to provide a scoring device adapted to be inserted into a chase attached to a cylinder of duplicator machine including a generally elongate body provided with a longitudinal slot for receiving means for scoring; and means for scoring composed of a strip of metal having one elongate side edge disposed in the slot, and an opposite side edge extending above the upper surface of the elongate base and provided with a narrowed edge adapted to score a work sheet.

BRIEF DESCRIPTION OF DRAWINGS

The foregoing and other objects of the invention will become apparent upon a consideration of the following specification and appended claims taken in conjunction with the accompanying drawings in which:

FIG. 5 is a perspective view of a perforation implement to be used in accordance with the present invention;

FIG. 6 is a perspective view of a scoring implement to be used in accordance with the present invention;

DETAILED DESCRIPTION

Figure 1:
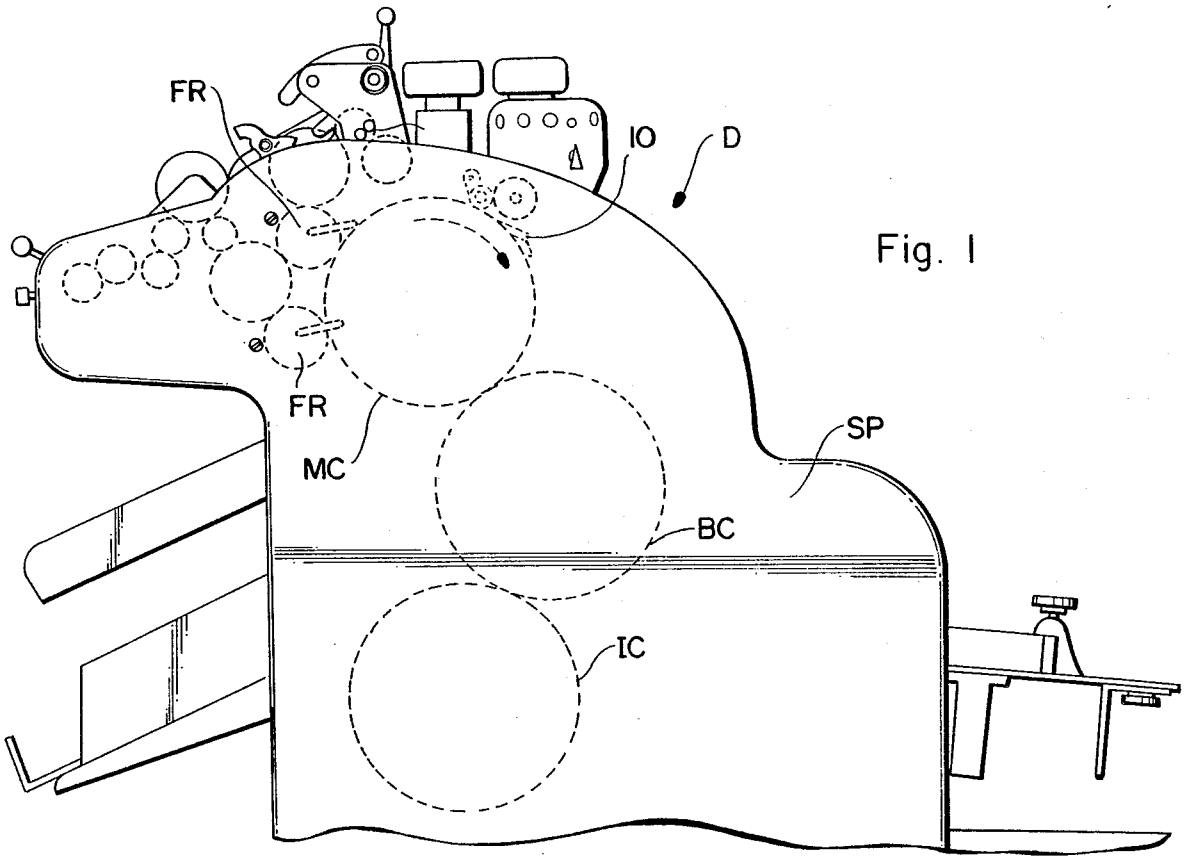
FIG. 1 is a view in side elevation of the general structure of a duplicating machine.

Referring now to FIG. 1, an automated offset lithographic duplicating machine is generally indicated as D. This machine includes a number of components which are conventional in well-known duplicating machines of this type. The framework of the duplicating machine D is formed primarily by a side plate SP which is maintained in spaced relationship with an opposite corresponding side plate (not shown). The side plates support the various elements of the duplicating machine D.

As illustrated in FIG. 1, a master cylinder MC, an offset or blanket cylinder BC, and an impression cylinder IC are mounted for rotation between the side plates. The master cylinder is adapted to hold a lithographic master, or plate, and for this purpose, is provided with a clamping mechanism 10. The clamping mechanism can be formed by any suitable master-gripping unit, as is conventional in the art.

For its primary function as a duplicator, the blanket cylinder BC is mounted for rotational and reciprocatory movement between the side plates, and is adapted to be selectively engaged by the master cylinder MC. When the master cylinder is moved into engagement with the blanket cylinder, the blanket cylinder receives a reversed or mirrored inked image from the lithographic sheet or plate mounted upon the master cylinder.

For this purpose, a stack of stock or master sheets is initially positioned upon a storage support tray (not shown) and the individual masters are then selectively removed by motor-driven upper and lower feed rollers (not shown) and driven thereby to a master-forwarding assembly F.

In normal operation, before the duplicating machine D begins a duplicating phase of operation, the machine must be subjected to a preparatory preduplicating phase, during which etch solution is applied to the master cylinder MC by an etching system which is conventional in structure and function and, therefore, will not be described in more detail than is furnished below. The ink and ink-repellent solution are then supplied to the master cylinder by means of an ink and water system.

Figure 2:
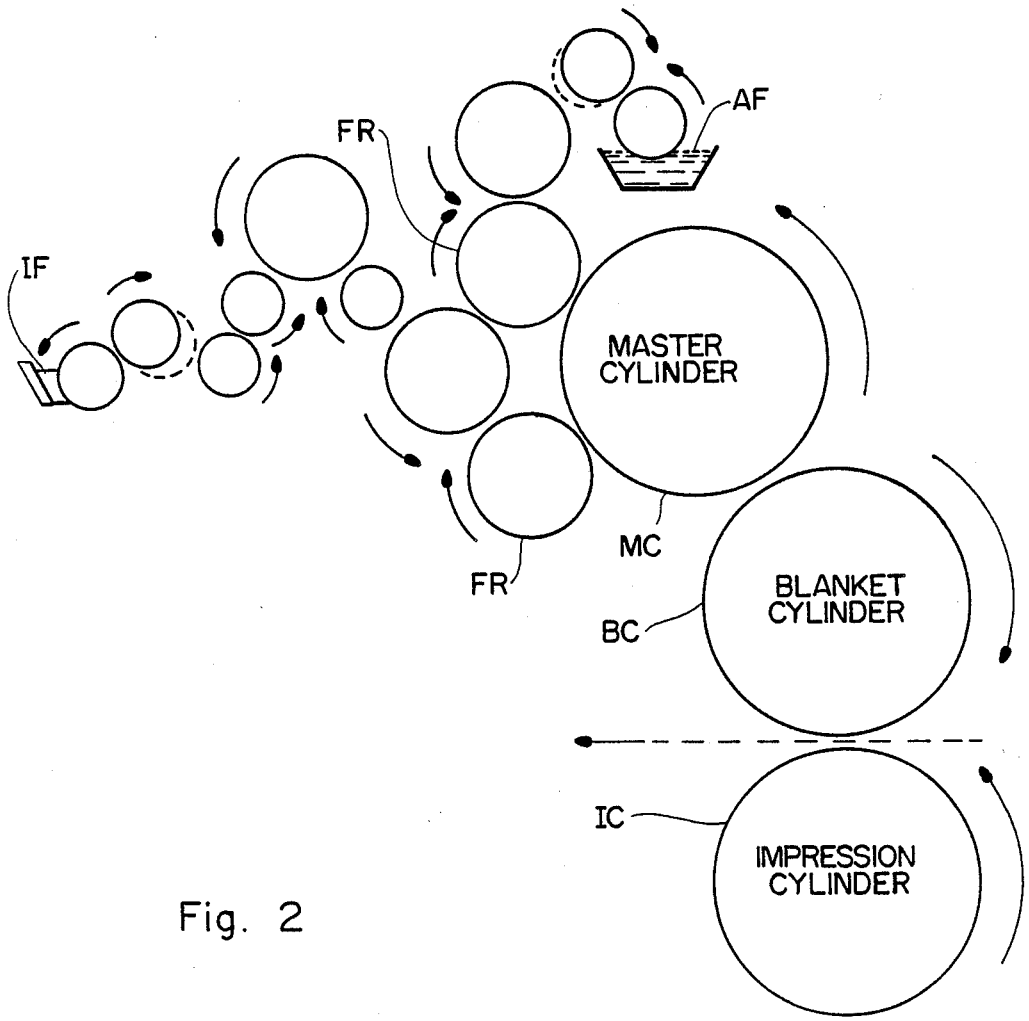
FIG. 2 is a schematic illustration of a suitable ink and water system typically used in a duplicator machine, such as that shown in FIG. 1, useful for purposes of the present invention.

A representative example of a suitable ink and water system is shown schematically in FIG. 2. The ink and water system is designed to transport a balance of ink and water to the master plate. In this particular embodiment, all 16 rollers which are covered with ink also carry water on its surface. First, ink is supplied to the rollers from the ink fountain IF, and then water is supplied from the water or aquatic fountain AF. The system of rollers, carrying both ink and water, supply water to the non-image area and ink to the image area of the master plate. In the course of the normal duplicating operation, the master plate is attached to the master cylinder. The two rollers carrying ink and water to the master are form rollers FR. As the cylinders rotate, the ink from the image area of the master cylinder is transferred, i.e., offset, to the blanket cylinder. As the paper passes between the blanket and impression cylinders, the impression cylinder applies pressure upward to press the sheet of paper against the blanket cylinder. The ink image on the blanket is then transferred to the paper.

Although the general structure of the duplicator machine and the general manner by which offset duplication is effective using such a machine do not in and of themselves form a part of the present invention, the foregoing explanation is given for a better understanding of the present invention which is directed to auxiliary devices to be attached to the blanket cylinder of a conventional duplicator machine, as described above, so as to adapt the machine for use in the novel and unique manner of the present invention to provide auxiliary functions in addition to conventional offset duplication. A preferred offset duplicator machine which is particularly suitable for use in accordance with the present invention is the brand and model commercially known as the AB Dick 360machine.

Figure 3:
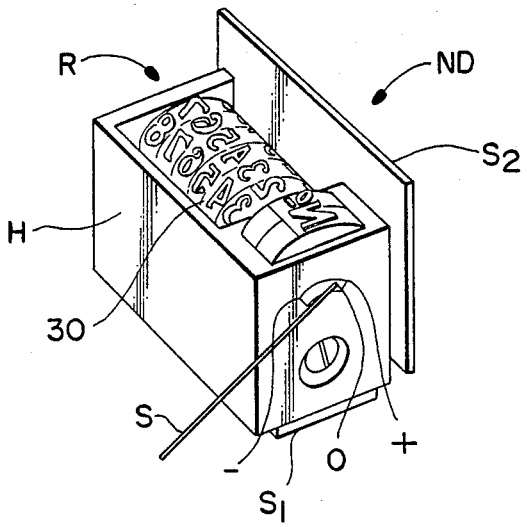
FIG. 3 is a perspective view of a numbering device to be used in accordance with the present invention.

Referring now to FIG. 3, a numbering device which is particularly preferred for purposes of the present invention is illustrated. The numbering device is identified generally as ND. As shown, the numbering device ND is composed of a plurality of printing disks 30 having the numerals "0" through "9" on their circumferences. The printing disks 30 are rotatably mounted on a shaft (not shown) within a housing H. Internal of each of the units ND is an indexing mechanism actuated upon each impression of the numbering unit against the stock or sheet of paper to be numbered. Each time the uppermost row of numbers is pressed against a sheet of paper, an appropriate mechanism is actuated so that the indexing operation is performed in such a manner that the number series carried by disks 30 is changed by one digit upon each impression.

The numbering device illustrated in FIG. 3 is a Heildeburg type having a lower plunger and a bimatic head which is capable of forward or backward numbering. The particular manner by which the sequence of numbers is printed is determined by initially setting the device for the proper sequencing. This is accomplished by inserting a stylist S through an orifice 0 located in an end surface side of the housing into a slot which is moved to the + position for forward numbering or the − position for backward numbering. The initial sequence of numbers may be set merely by rotating the printing disks by hand until the desired sequence of numbers appears along row R of the numbering device. As with all implements to be used in accordance with the present invention, it is important that the numbering device be positioned properly within the chase and adjusted so that the impression surfaces of the numbering tumblers are spaced so as to contact the stock in a way which clearly numbers each sheet of stock material. As described herein, the chase itself is provided with means for adjusting the position of the various implements within the channel of the chase. In those instances where the depth of the channel of the chase is deeper than the height of the numbering device, however, a shim $S_1$ may be attached to the base of the numbering device. The purpose of the shim is to raise the base of the numbering device precisely to a height necessary to trip the number plunger and print the number.

The shim, however, should not raise the base so high as to damage the numbering head or the cylinder head with which the numbering device makes contact. In the preferred embodiment of the present invention described herein, a 0.78 inch thick shim is attached to the base of the numbering device to cause it to seat firmly and securely within the channel of the chase. A shim $S_2$ may also be attached to a side of the numbering device to provide a uniform surface for contact by the adjustment screws 72 to firmly secure the numbering device in position within the channel of the chase. In the preferred embodiment described herein, a 1/16 inch thick shim is attached on the side of the numbering device receiving the adjustment screws.

Figure 4:
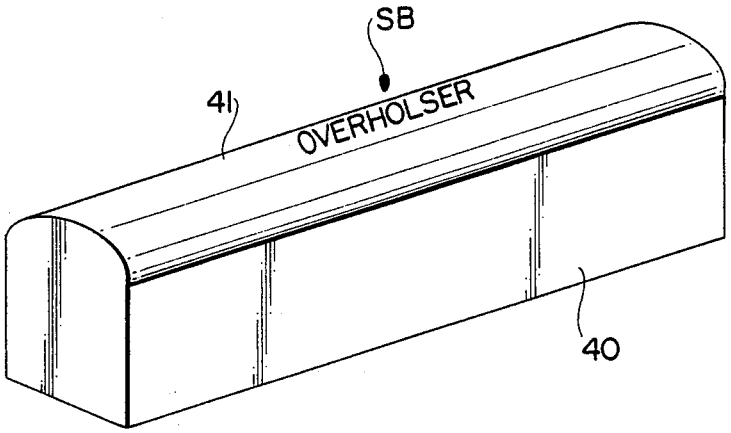
FIG. 4 is a perspective view of a signature block to be used in accordance with the present invention.

FIG. 4 illustrates a signature block SB in accordance with the present invention. As shown, this is composed of a generally elongate base 40, preferably having a curved upper surface, in which a raised printing surface 41 is connected. The curvature of the upper surface preferably has an arc which is essentially the same as the arc of the cylinder to which the chase is attached so as to ensure smooth operation. In this embodiment, the raised printing surface is in the form of block letters, but may be formed to have any shape or design which is desired, such as a signature, a logo, crest or other identifying or decorative symbol. The base may be made of any somewhat rigid material such as metal or wood, and polymeric substances such as rubbers and plastics are suitable for this purpose. The printing surface, however, is preferably metallic or other material normally used in the printing art to transfer impressions.

In FIG. 5, a perforating implement or perf-bar PI is shown as being composed of a generally elongate base 50 provided with a longitudinal slot 51 for receiving the perforating strip 53. The perforating strip 53 is formed from a continuous strip of a suitable firm, but preferably flexible, material, for example thin steel stock, and preferably a length of conventional perf-rule. The thin strip is provided along one longitudinal edge with a series of teeth or projection portions 54. The projections are contiguously arranged and are integral with the perforating strip. The perf-rule may be selected from a variety of conventional strips of metal exhibiting different degrees of temper-hardness and numbers of teeth per inch. For purposes of the present invention, a perf-strip having seventeen teeth per inch is preferred. The top of each of the projections are preferably bevelled into a narrowed, triangular configuration in elevation and is composed of converging flat surface sides **54*a* and 54*b* and parallel front and back surfaces 54*c* and 54*d*. The outer edge of the projection terminate in a common plane and are contiguous at their bases. Each of the projections are essentially identical in size and shape, although their size and spacing may be varied. The projections are arranged in alignment and extend medially of the base along the longitudinal center line thereof. The base 50 is dimensioned so that it can be placed within the chase, described in further detail below, for attachment to the blanket cylinder. As shown, the base 50 has a flat upper surface. It is also envisioned that the upper surface of the base may be curved in a manner similar to the upper surface of base 40 of the signature block. The side of the base may also be provided with notched areas NA, shown in the upper corners of the side adapted to receive adjustment screws 76*a* and 76*b***, described below with respect to the chase. The notched areas, however, can extend from the upper surface to the lower surface of the base.

Referring now to FIG. 6, the scoring implement or score bar SI of the present invention is illustrated. As shown, the scoring implement is composed of a generally elongate base 60 provided with a longitudinal slot 61 for receiving the scoring strip 63. The scoring strip 63 is also formed in a continuous strip from a suitable firm, but preferably flexible, material, for example thin steel stock similar to that used for the previously described perf-strip, but in this case not provided with teeth. The thin strip is provided along one longitudinal side with a narrowed edge 64 which is preferably bevelled into a triangular configuration in elevation. The narrowed edge 64 extends medially of the base along the longitudinal center line thereof. As in the previous instance, the base 60 is dimensioned so that it can be placed within the chase, described in further detail below, for attachment to the blanket cylinder. Also, the upper surface of base 60 may be curved and the upper corners of the base provided with notched areas NA in a manner similar to base 50.

The previously mentioned chase C for receiving the numbering device, signature or design block, perforating implement and/or scoring implement, is illustrated in FIG. 7. As shown in FIG. 7A, the chase includes a generally elongate channel 70 having a U-shaped cross-section. In FIG. 7B, the chase is an elongate element in the form of an angle iron having a generally L-shaped cross section 79. In either embodiment, the chase is preferably made from plastic or a metallic substance and preferably steel. The chase may be either molded into the desired shape or fabricated from metal strips. The dimensions of channel 70 of the chase should be sufficient to accommodate any of the previously described implements mounted in their bases. In this regard, the sides of the chase should be of such a height that the top surface of the base for each of the implements extends slightly above the top edge of either side of the chase. In this regard, it is particularly important to seat the perf-bar and score-bar on the chase so that the working edge of the respective implements does not contact the impression cylinder. The width of the base of the channel of the chase should be slightly larger than the width of the base for the implements so that the implements can be easily inserted and removed with respect to the channel without resorting to an excessive amount of force and also to provide leeway for adjustments in alignment of the particular implement within the chase.

To this end, chase 70 is provided with a series of tapped orifices 71 at spaced intervals along the outer side **71*a* of the generally U-shaped channel. The tapped orifices 71 are provided to receive set screws 72 which are locked into position by locking nuts 73. As shown, set screw 72 preferably is provided with an integral head 74 provided with a hex-type cavity and knurled circular peripheral edge for turning screw 72 within orifice 71 to secure and adjust the appropriate implement into proper position within the U-shaped channel of the chase. Alternatively, the outer side of chase 70 may be provided with an elongate slot 71*s*, shown in FIG. 7C, instead of tapped orifices 71 so as to permit substantially infinitely variable positioning of the implement along the length of chase 70. In addition to the use of set screws alone for this purpose, a sliding spring clamp or keeper type clamp C may be mounted on the outer side of the chase. As shown, set screws 72 pass through the clamp and the slot in the outer side of the chase and are adapted to tighten against an implement positioned within an area of the channel of the chase adjacent the location of the clamp on the outer side of the chase. When the set screws are loosened, the clamp is permitted to slide along the length of the chase guided by the set screws passing through the slot. In another embodiment, a cradle CR may be mounted in a similar manner over the outer side of the chase. Unlike the sliding clamp which is an inverted U-shaped shaped member m provided with holes h to permit passage of the set screws, the cradle includes a base surface bs attached at its outer side to a similarly constructed inverted U-shaped member CRm and at its inner side to a upright side provided with an inwardly extending flange. The cradle is designed to fit within the channel and receive one of the implements used in accordance with the present invention, such as the numbering device ND. Thus, in this embodiment, the numbering device would be placed in the cradle rather than directly in the channel. The set screws 72 function in essentially the same manner as previously described in securing the numbering device in position within the chase. The opposite side of the U-shaped channel of the chase is also provided with at least two tapped orifices 75*a* and 75*b* in the upper extreme corners for receiving threaded adjustment screws 76*a* and 76*b*. In brief, the adjustment screws 76*a* and 76*b* permit the chase to be properly positioned after being attached to the blanket cylinder as hereinafter described. To this end, base side 77 of the chase is provided with at least two orifices 78*a* and 78*b*, preferably counter-sink openings, located within the channel so as to align with the screw-holes on the blanket cylinder for attaching the chase to the blanket cylinder at this location. The lower edge between the lower base surface side and the lateral side of the chase provided with tapped orifices 71** are shown as being provided with a beveled edge, preferably in two locations, at a 30° angle with respect to the base surface side of the chase.

Figure 7A:
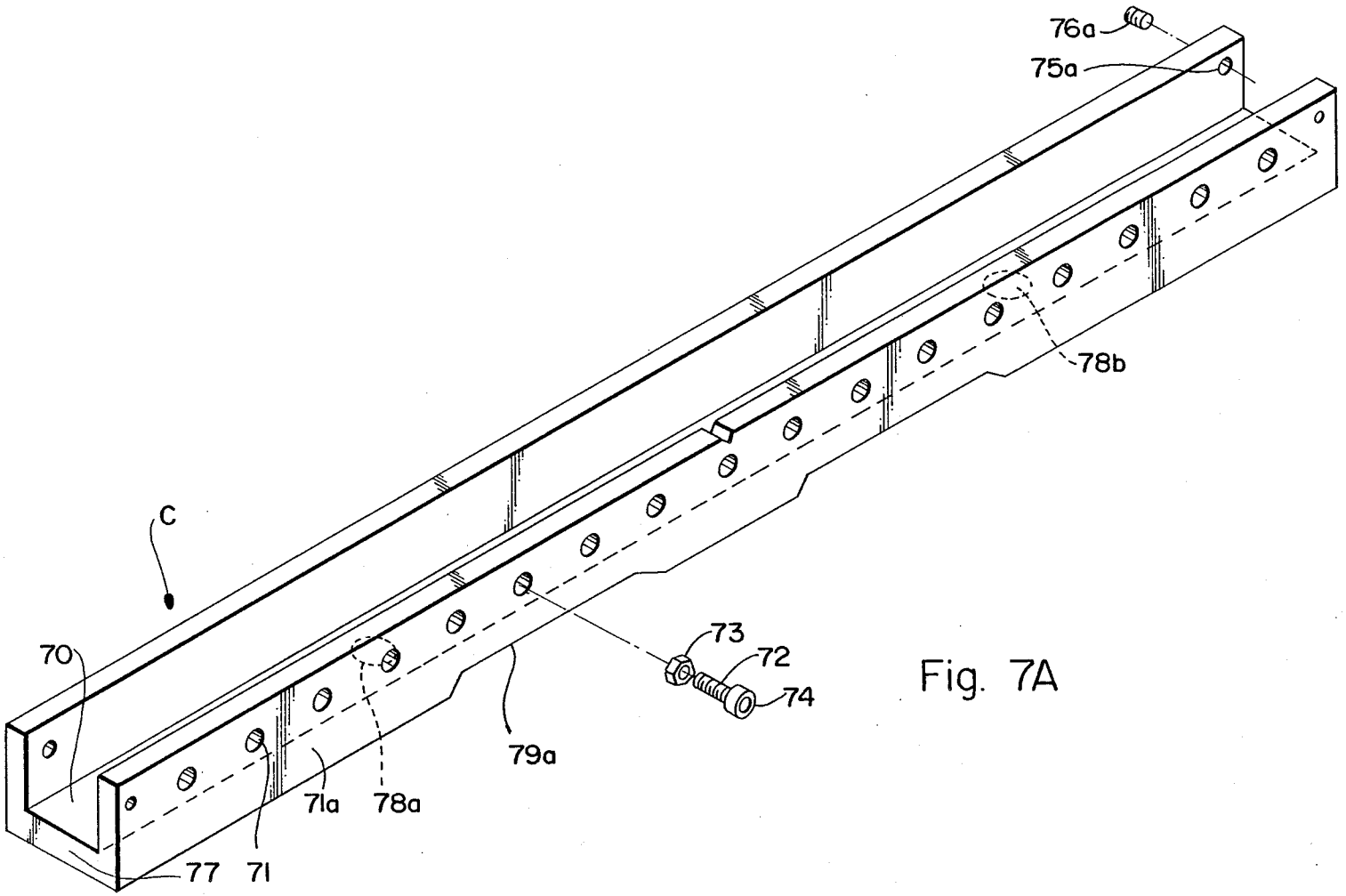
FIG. 7A–D are perspective views of chases adapted in accordance with the present invention to receive the numbering device, signature block, perforating implement, and scoring implement, adapted to be attached to the blanket cylinder in accordance with the present invention.
Figure 7B:
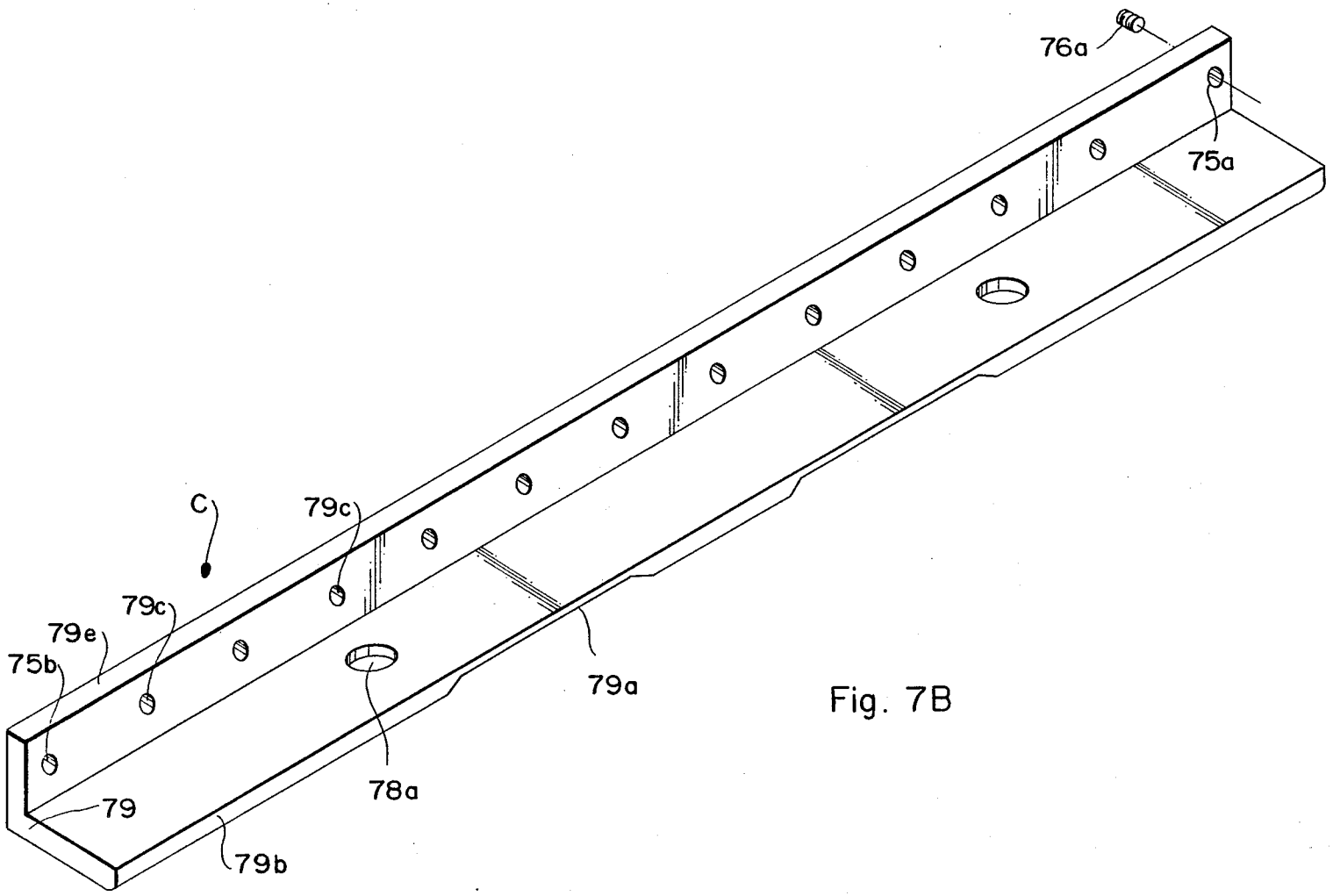
Figures 7C, 7E, 7F:
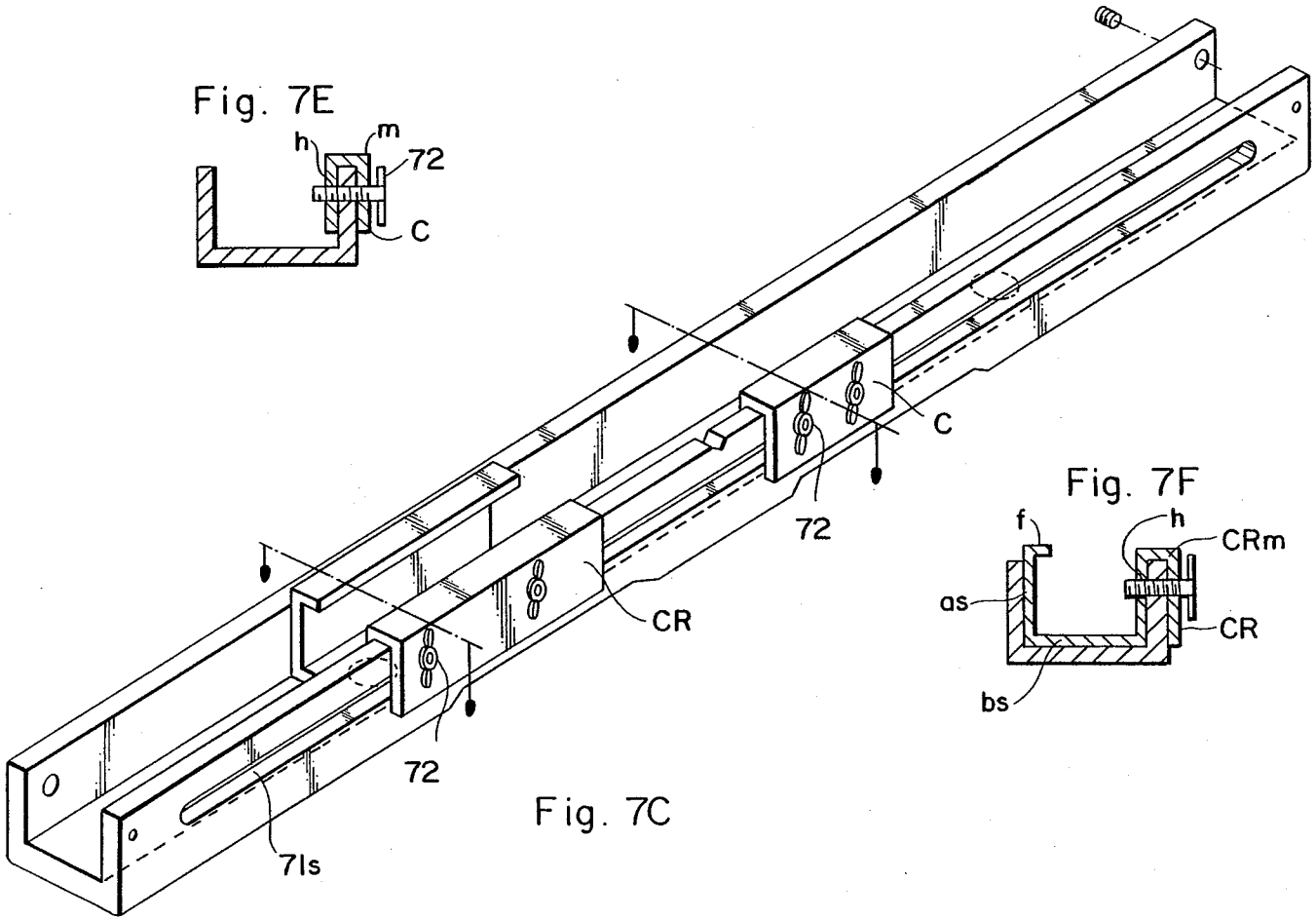
FIG. 7E is a cross sectional view of the keeper type clamp shown as element C mounted on chase 70 in FIG. 7C.
FIG. 7F is cross sectional of the cradle shown as element CR mounted in chase 70 in FIG. 7C.
Figure 7D:
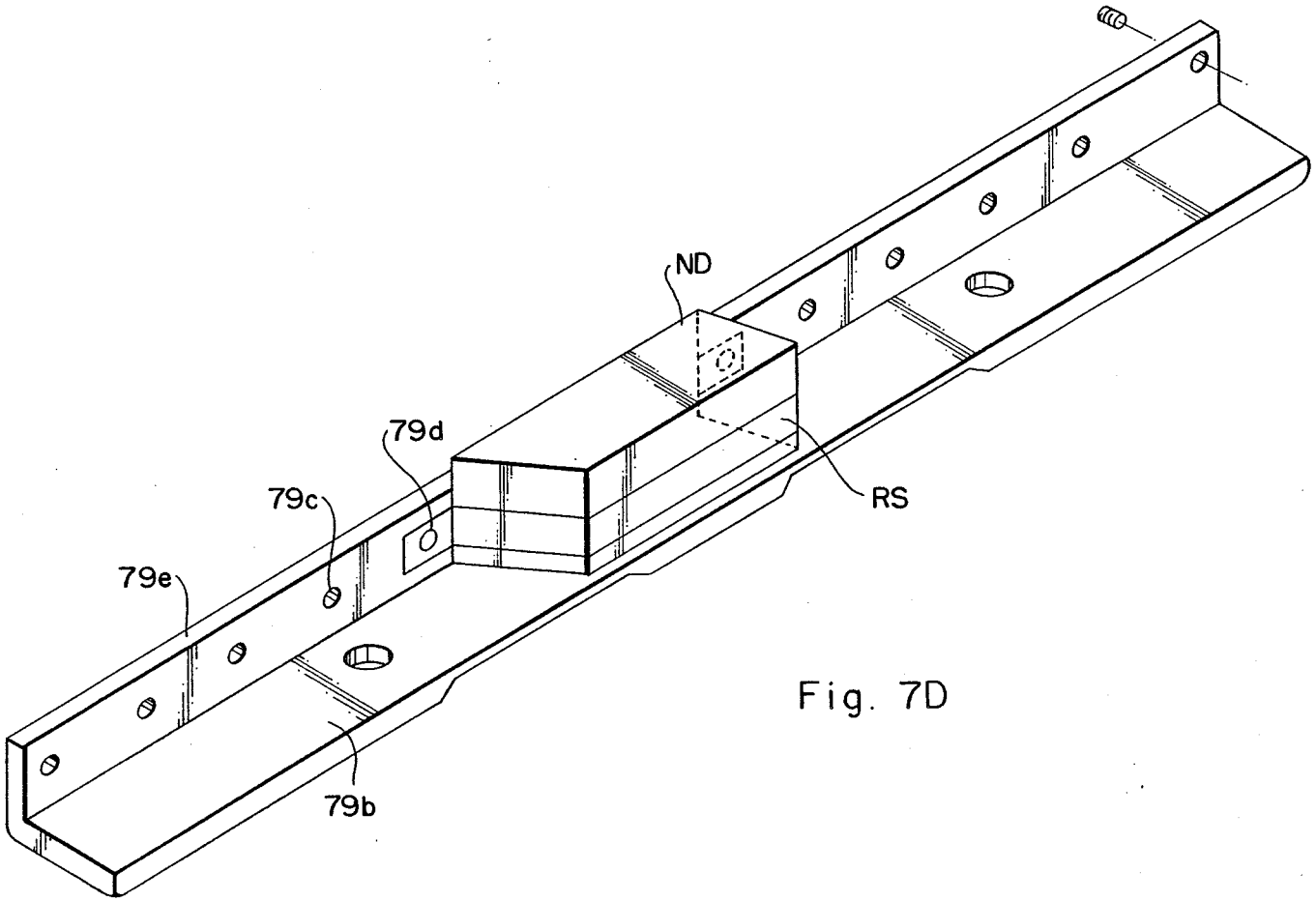

The chase 79 is composed of a base side **79*b* and a lateral side 791 which join preferably at right angles to form a generally L-shaped chase. The base 79*b* has essentially the same features as the base side of the U-shaped channel of chase 70. In this regard, the base side 79B is provided with at least two orifices 78*a* and 78*b*, which are preferably counter-sink openings, located along the base side so as to align with the screw-holes on the blanket cylinder for attaching the chase 79 to the blanket cylinder at this location. In a manner similar to the U-shaped chase, the outer free edge of the base side of chase 79 is shown as being beveled, preferably in two locations, at an angle of preferably 30°. Similarly the lateral side 79*b* is also provided with at least two tapped orifices 75*a* and 75*b* in the upper extreme corners for receiving threaded adjustment screws 76*a* which serve essentially the same purpose as previously described. Referring now to FIG. 7D, the lateral side wall of chase 791, however, is also provided with a series of tapped holes 79*c* for receiving screws or bolts 79*d* for securing a retaining strap RS around the numbering device ND or other suitable implement to secure the implement positioned on the base side 79*b* firmly against lateral side 791**.

Figure 8A:
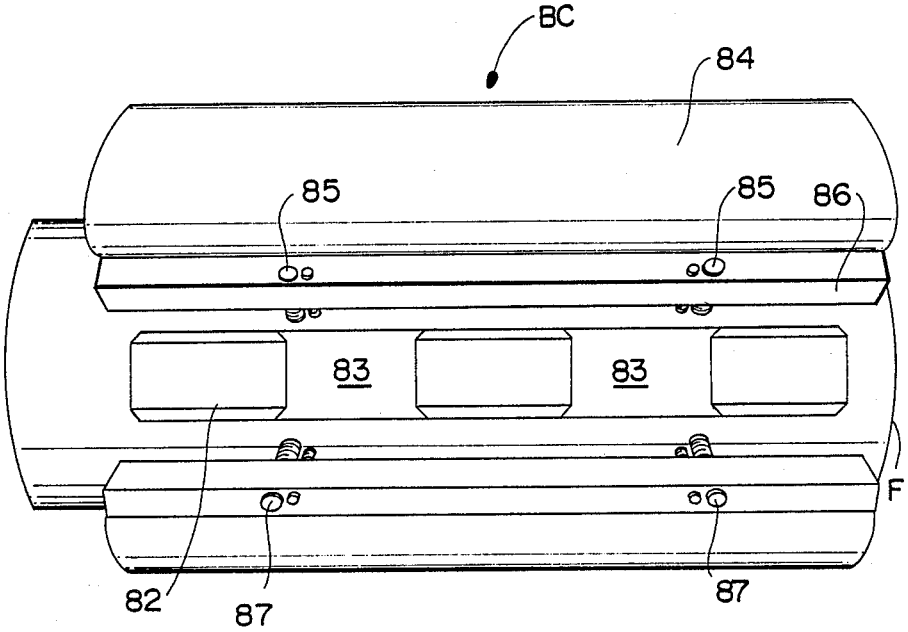
FIGS. 8A and 8B are a perspective view of a blanket cylinder to which the chase shown in FIG. 7 is adapted to be mounted; and a perspective view of a blanket cylinder to which the chase shown in FIG. 7 is mounted.
Figure 8B:
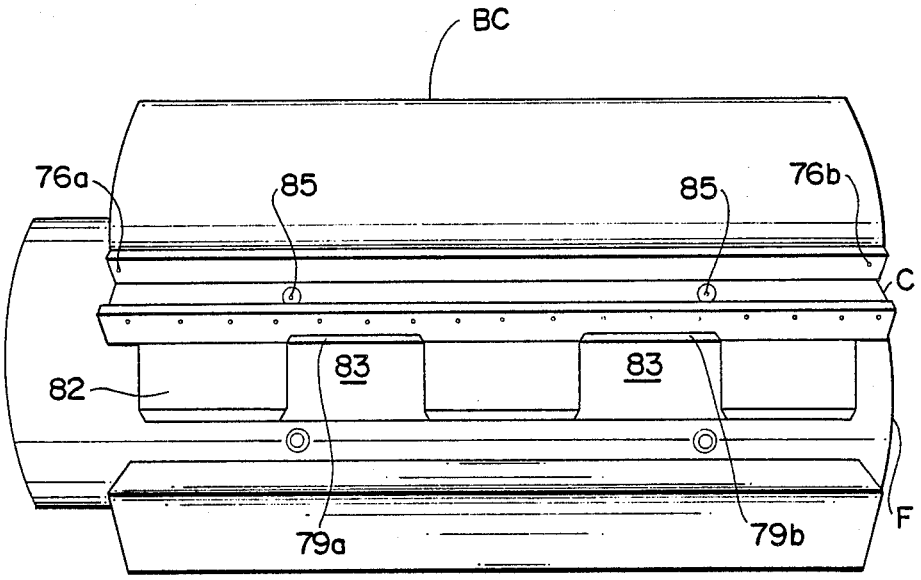

Referring now to FIG. 8, the blanket cylinder will now be described. In this regard blanket cylinder BC is composed of a frame F mounted for rotation on a shaft (not shown). The blanket cylinder frame include two generally circular end-plates (not shown) maintained in spaced relationship from each other by generally elongate struts 82 attached to and extending between the end plates. The struts are attached to or integral with spanning blocks or protuberances 83 arranged so that the frame has a generally cylindrical profile.

In normal operation of the duplicator machine, the blanket cylinder is provided with a blanket 84 attached by two socket head cap screws 85 that secure the top blanket bar 86 to the struts. The blanket B is then wrapped around the blanket cylinder and has its other end attached to another strut of the blanket cylinder frame by two socket head cap screws 87 in a manner shown in FIG. 8A. In order to remove the blanket B so as to ready the blanket cylinder frame to receive the generally U-shaped chase of the present invention, the two socket head cap screws 85 that secure the top blanket bar are loosened and removed. The bar is then removed from the struts and the blanket cylinder frame turned counterclockwise until the bottom blanket bar is accessible. The two socket head cap screws 87 are then loosened and removed so as to remove the lower blanket bar.

In order to mount the chase C to the blanket cylinder frame, the chase C is located in the channel in either the lower end or the upper end, but preferably the latter, of the blanket cylinder and secured thereto with two socket head cap screws 85. Once the chase has been secured in place by means of the two socket head cap screws, adjustment screws **76*a* and 76*b* may be adjusted, as deemed necessary, so as to ensure that the chase is seated securely within the channel in the blanket cylinder frame. In addition, the corner formed by the base surface side and the lateral side of the chase provided with orifices for the set screws is provided with a bevelled edge, preferably in two locations, as bevelled edge 79*a* and bevelled edge 79*b*, so that the chase will fit snugly against the protuberances 83** on the blanket cylinder frame.

Figure 9A:
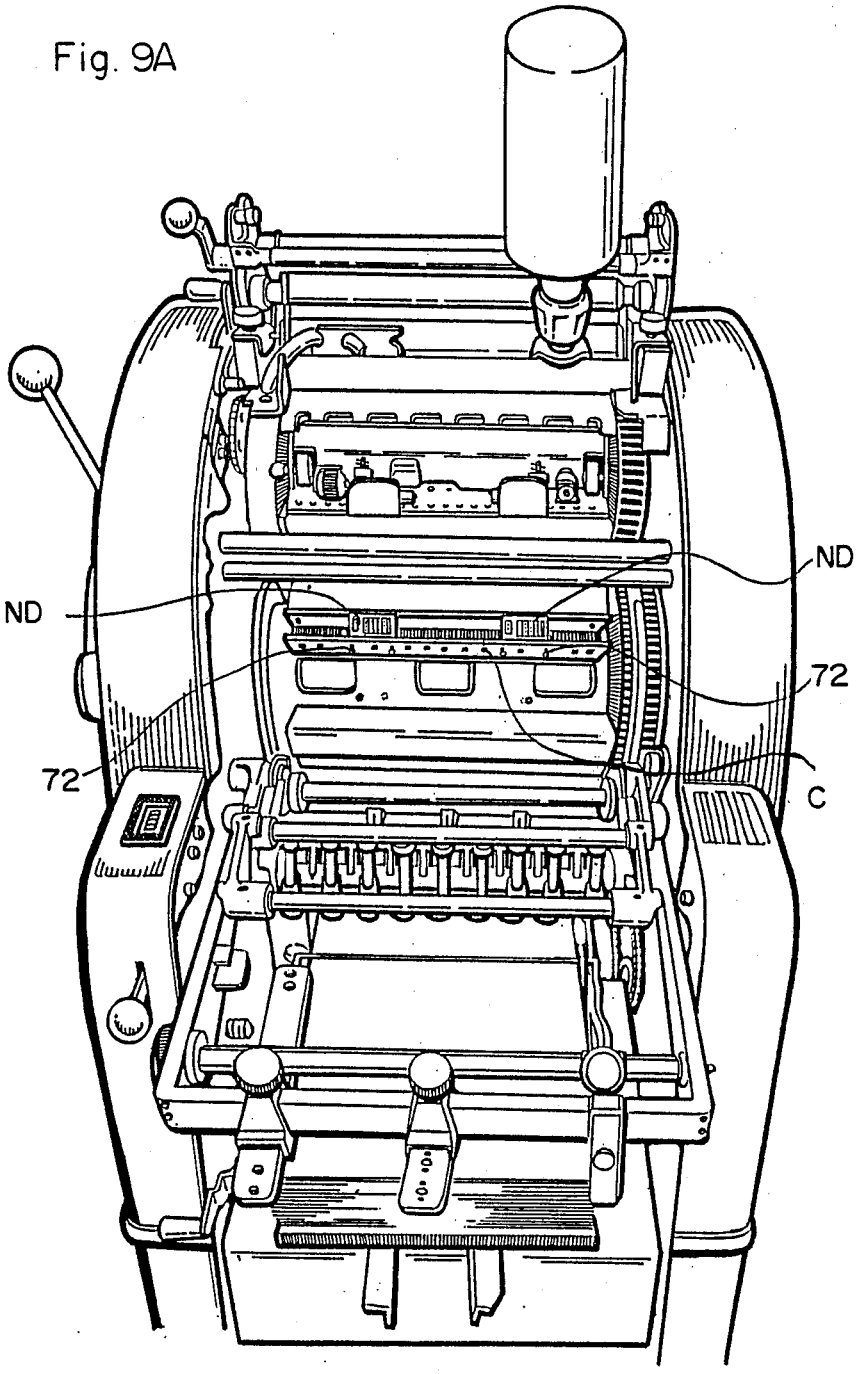
FIGS. 9A–D are perspective views of a duplicator machine modified in accordance with the present invention showing a chase, in which the numbering device, signature block, perforation implement and scoring implement, are positioned, mounted on the blanket cylinder of the machine.
Figure 9B:
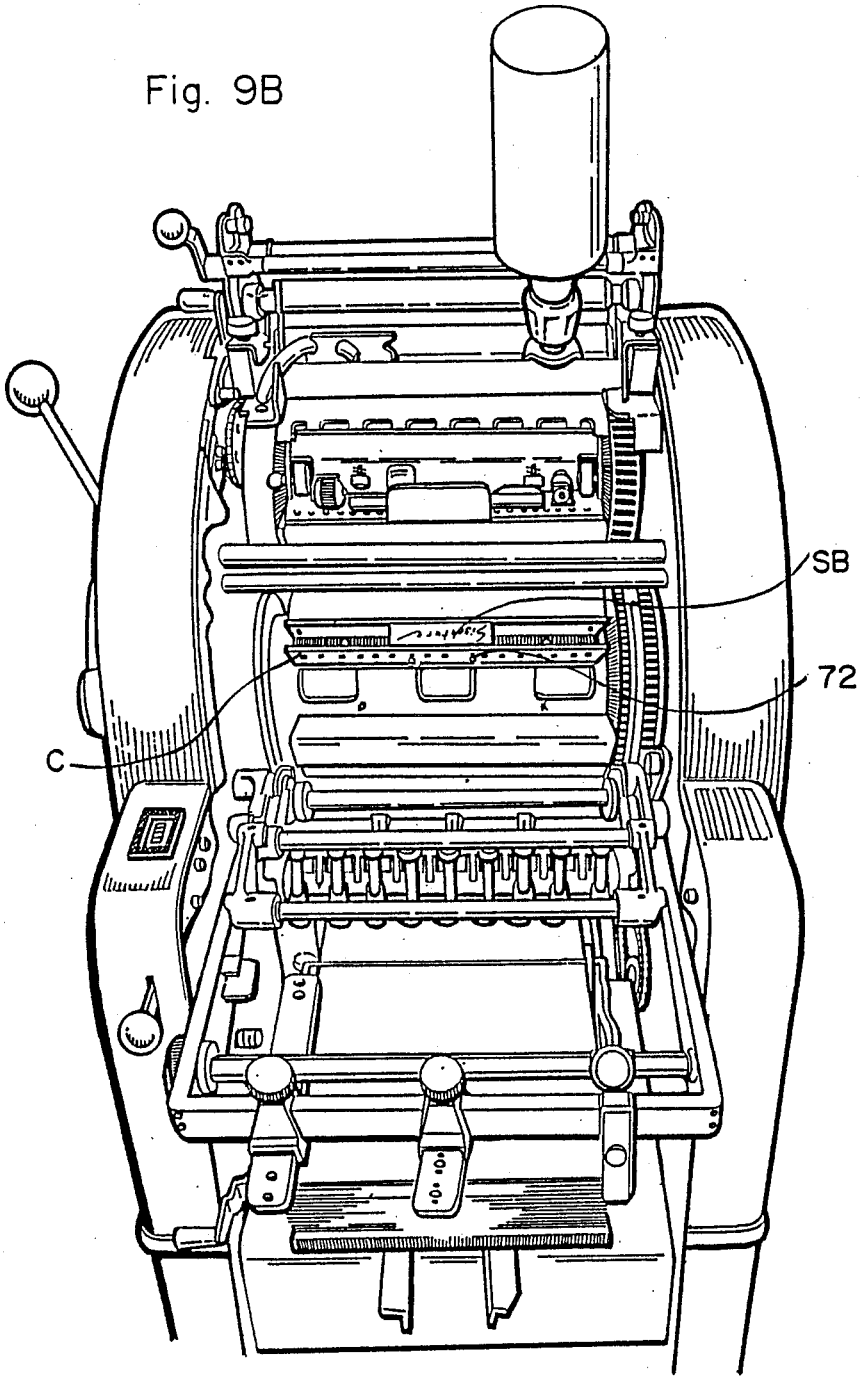
Figure 9C:
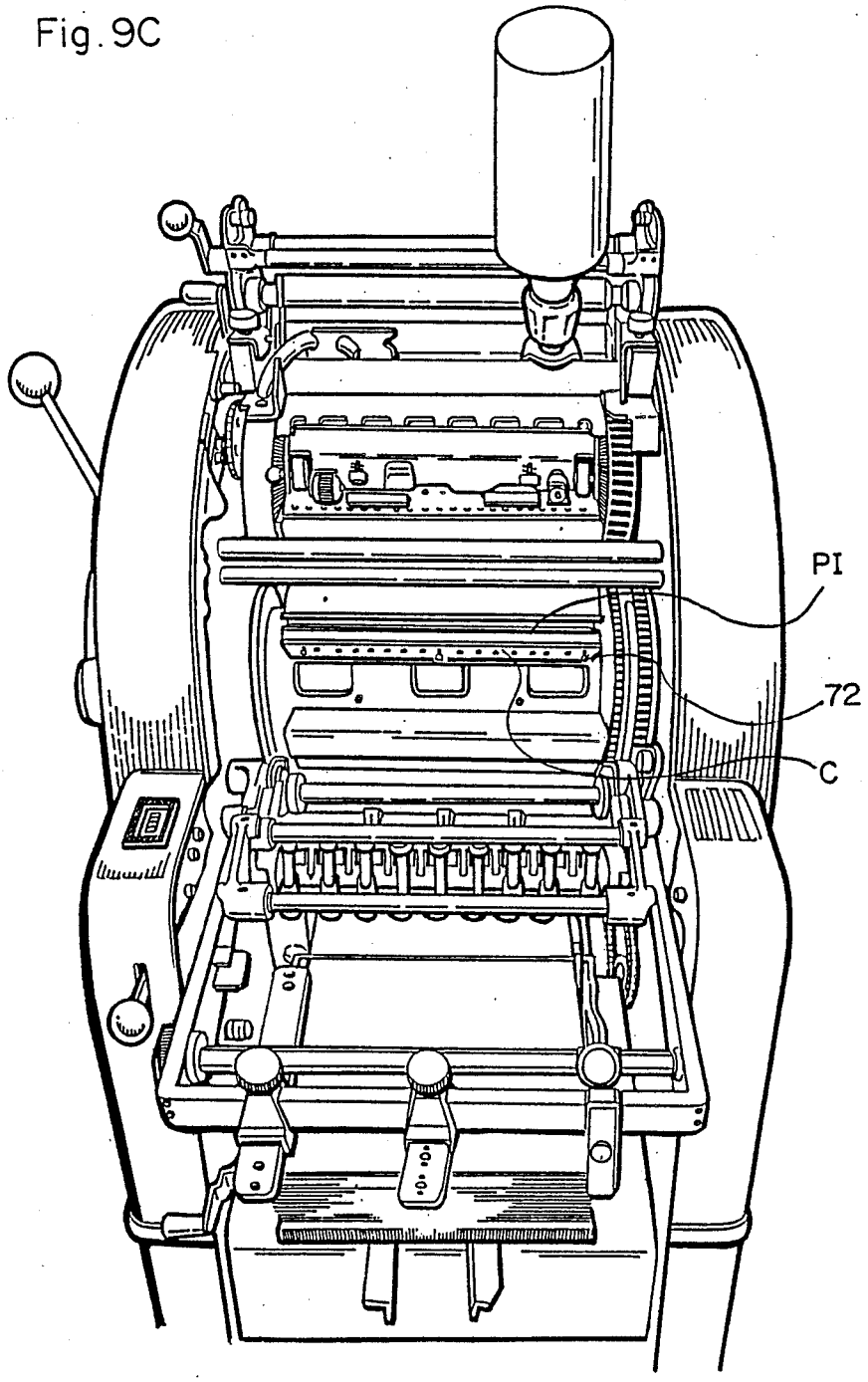
Figure 9D:
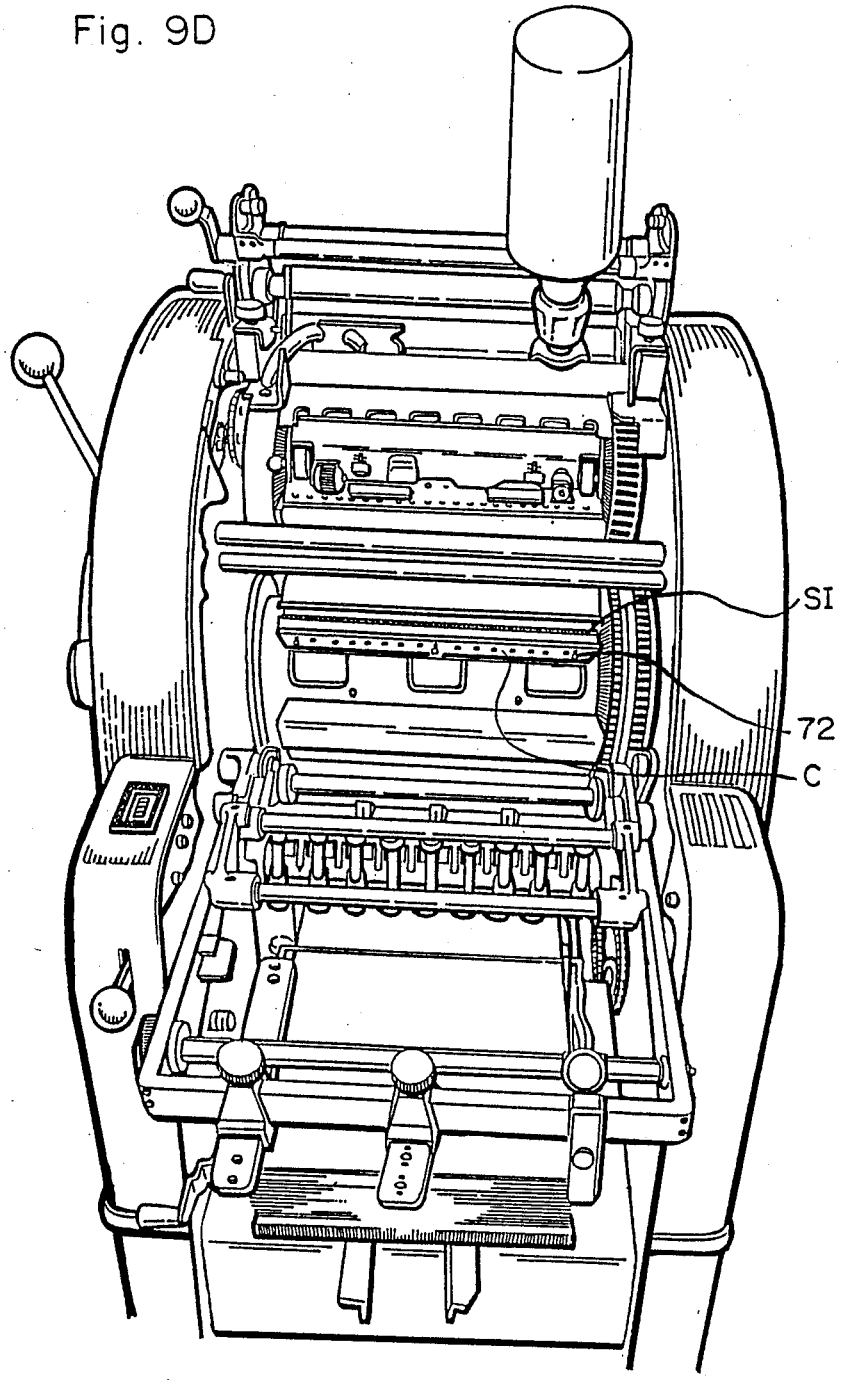

The previously described adjustments are important so that the numbers on the numbering head, as well as the other implements used in accordance with the present invention which are to be pressed against the stock, are flush with the surface of the arc of the surface of the blanket cylinder frame. Otherwise, the numbers, or other designs, intended to be printed may be incomplete if they do not meet the stock squarely upon impact FIGS. 9A–9E illustrate certain of the implements which may be positioned in the chase C mounted to the blanket cylinder in accordance with the present invention shown in FIG. 8B. As shown in FIG. 9A two numbering devices ND, described above with respect to FIG. 3, are shown mounted within the trough of chase C and secured in positioned by means of screws 72. A signature block SB is similarly mounted within chase C, as shown in FIG. 9B. FIGS. 9C and 9D illustrate performation and scoring implements, described above with respect to FIGS. 5 and 6, respectively, mounted within chase C in a manner similar to the previously mentioned implements.

Figure 10A:
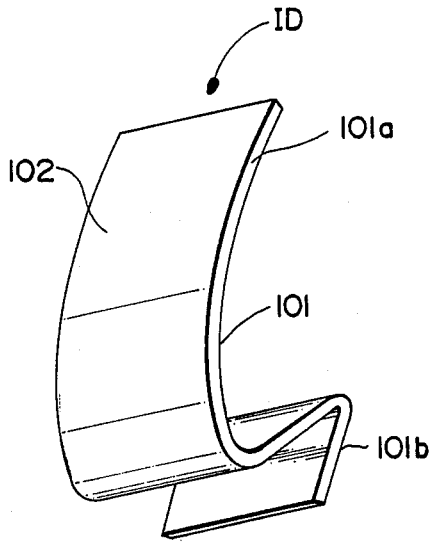
FIG. 10A is a perspective view of an inking pad adapted to be mounted to the master cylinder and FIG. 10B is an illustration showing the inking pad device placed in position on a cylinder of a duplicator machine.
Figure 10B:
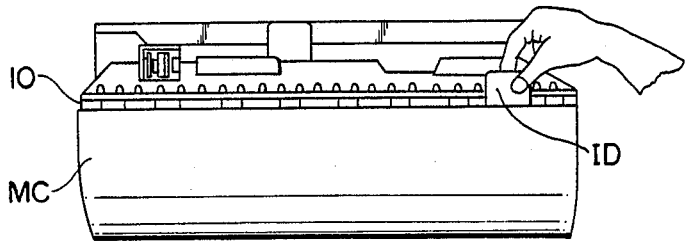

Turning now to FIG. 10A, an inking pad device to be mounted to the master cylinder and aligned to contact the numbering head or design block positioned within the chase is illustrated. The inking device is composed of an elongate bracket 101, preferably made from metal such as steel, having a generally S-shaped transverse cross-sectional configuration. The bracket has a relative long upper extended portion **101*a* to which is attached an inking pad 102. The pad may be made from any material normally used in the printing art to transfer ink from an ink source to an impression element. For purposes of the present invention, however, the pad is preferably made from a member selected from the group of closed cell neoprene, rubber and polyurethane. The elongate upper portion 101***a* is curved to have an arc corresponding to the arc of the cylinder to which it is attached as to impart a similar curvature to the surface of pad. The lower extended portion 101*b* is relatively short and is adapted to be placed and secured into position by clamp 10 on the master cylinder. The inking pad device may vary in length from one extreme where it is long as the full width of the master cylinder, to the opposite extreme where it has a length corresponding to the length of the numbering device or design block with which it is to be aligned and used. The S-shaped bracket is designed so that the inking pad device is secured by the clamp 10 in such a position that the surface of the inking pad is essentially at the same level that the master plate would be if the master plate were installed on the master cylinder. Thus, as the master cylinder rotates, the inking pad contacts the form rollers FR which transfer ink to the surface of the inking pad for supplying a suitable amount of ink to the numbering device or design block for imprinting on the stock. An inking pad device is shown in FIG. 10B as being attached by clamp 10 to the master cylinder in position which ultimately aligns with the positions of the numbering devices and design block so that as the cylinders rotate, the surface of the inking pads will contact the printing surfaces of the numbering devices and the design block. It will be understood, however, that when the perforation implement and/or the scoring implement are positioned within the chase, the inking pad is not attached to the master cylinder.

Figure 11A:
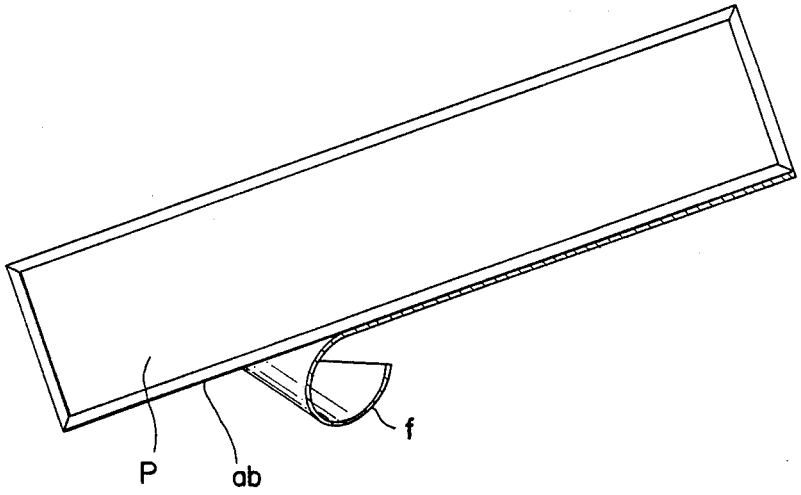
FIG. 11A is a perspective view of the strip of padding adapted to be attached to an impression cylinder of a duplicator machine and FIG. 11B is an illustration showing the protective strip being placed in position on the impression cylinder of a duplicator machine modified in accordance with the present invention.
Figure 11B:
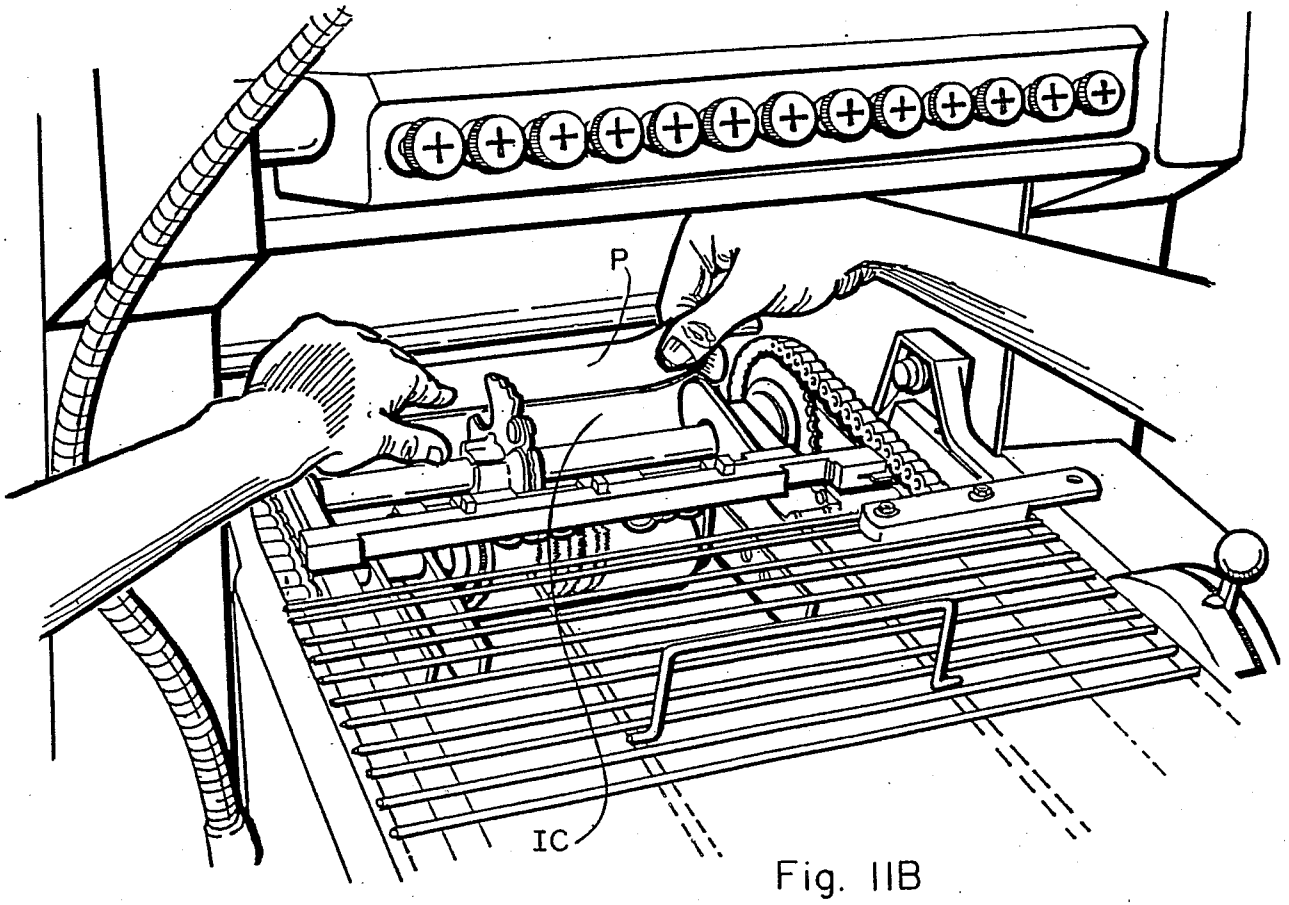

In this regard, when the blanket cylinder of a duplicator machine is modified in accordance with the present invention to receive a chase within which a perforation and/or scoring implement is positioned, the present invention also provides for mounting a piece or strip of padding P, such as neoprene rubber preferably having a porosity reading of 70–90, or a piece of duplicator blanket material, onto the impression cylinder in the area where the perf and/or score bars come into contact with the surface of the impression cylinder. The protective piece of padding may have any dimension so long as it covers the surface of the impression cylinder which would otherwise be contacted by the perf and/or score bars so as to prevent damage of the surface of the impression cylinder. As shown in FIG. 11A, preferably the protective padding is an elongate strip of neoprene rubber having a length substantially the same as the width of the impression cylinder and a width between about 1–2 inches. The strip is affixed to the surface of the impression cylinder preferably with a sufficiently strong adhesive to bond the strip to the cylinder surface so as to prevent its displacement during operation, and yet permits the relatively easy removal of the strip when no longer necessary. Preferably the protective strip is provided with an adhesive backing ab which is covered by a removal film f material which may be peeled away to expose the adhesive backing prior to installation on the impression cylinder. FIG. 11B illustrates the application of protective strip P to the surface of an impression cylinder IC of a duplicator machine whose blanket cylinder has been modified in accordance with the present invention to perform perforating or scoring operations.

Accordingly, the novel and unique arrangement of elements of the attachments of the present invention permit a conventional duplicating machine to be modified so as to become a multi-purpose machine, rather than being strictly limited to the printing operation for which it was intended.

From the foregoing description, one skilled in the art can easily ascertain the essential characteristics of this invention and, without departing from the spirit and scope thereof, make various changes and modifications of the invention to adapt to various usages and conditions.

What is claimed is:

1. A method for converting an offset machine, including a master cylinder, a blanket cylinder having a blanket cylinder frame and blanket to said blanket cylinder frame, and an impression cylinder into a multi-purpose machine comprising: (a) removing said blanket from said blanket cylinder frame; and (b) attaching means for direct impression against worksheets to be passed between said blanket cylinder and said impression cylinder to said blanket cylinder frame.

2. The method for converting an offset machine in accordance with claim 1, wherein said means for direct impression is a member selected from the group consisting of a numbering device, a signature block, a design block, a perforation device, and a scoring device.

3. The method for converting an offset machine in accordance with claim 2, wherein said means for direct impression is a means for imprinting selected from the group consisting of a perforation device and a scoring device, and the method further mounting a pad of protective material onto said impression cylinder in the area where said means for imprinting comes into contact with the surface of said impression cylinder.

4. The method for converting an offset machine in accordance with claim 1, wherein said means for direct impression is a means for imprinting selected from the group consisting of a numbering device, a signature block, and a design block, and the method further comprises connecting an ink pad device to said master cylinder so as to supply ink to said means for direct impression.

* * * * *